US005918431A

United States Patent [19]

Schiedegger et al.

[11] Patent Number: 5,918,431

[45] **Date of Patent: *Jul. 6, 1999**

[54] SPLIT-BLOCK RECESS MOUNT APPARATUS

[75] Inventors: Charles E. Schiedegger, Metamora; Richard J. MacLeod, Brighton, both of Mich.

[73] Assignee: Tapco International, Plymouth, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,278

[22] Filed: Oct. 13, 1997

Related U.S. Application Data

[63] Continuation-in-part of application No. 08/715,999, Sep. 19, 1996, abandoned.

[51] Int. Cl.[6] ..... E04C 2/52

[52] U.S. Cl. ..... 52/220.1; 248/56

[58] Field of Search ..... 248/56, 57; 52/220.8, 52/34, 28, 220.1

[56] References Cited

U.S. PATENT DOCUMENTS

| | | | |
|---|---|---|---|
| 2,319,410 | 5/1943 | Leary | 248/220.8 |
| 4,327,841 | 5/1982 | Wimberly . | |
| 4,726,152 | 2/1988 | Vagedes et al. . | |
| 4,765,110 | 8/1988 | MacLeod . | |
| 4,875,318 | 10/1989 | MacLeod et al. . | |
| 4,920,708 | 5/1990 | MacLeod et al. . | |
| 5,000,409 | 3/1991 | MacLeod et al. . | |
| 5,293,920 | 3/1994 | Vagedes . | |
| 5,303,522 | 4/1994 | Vagedes . | |
| 5,326,060 | 7/1994 | Chubb et al. . | |
| 5,349,799 | 9/1994 | Schiedegger et al. . | |
| 5,402,611 | 4/1995 | Vagedes . | |
| 5,491,936 | 2/1996 | Logan et al. . | |
| 5,526,619 | 6/1996 | Vagedes | 248/58 X |

*Primary Examiner*—Ramon O. Ramirez
*Attorney, Agent, or Firm*—Howard & Howard

[57] ABSTRACT

A split-block recess mounting apparatus having a two-piece base assembly and a one-piece cover member. The two pieces of the base assembly include structure for allowing interlocking of the two pieces together before the pieces are secured to an exterior surface of a building by nails or threaded screws. Each of the two pieces includes a central wall portion having a cutout which, when the two pieces are secured together, forms a continuous opening for permitting passage of a conduit, cable or other elongated member therethrough. The cover member is securable without any external fastening elements to upstanding inner wall portions of the two pieces of the base assembly to form a means for providing a decorative, finished looking appearance to an area on an exterior surface of a building surrounding a conduit or other member projecting through the exterior surface. In preferred embodiments the upstanding inner wall portions include inter-engaging portions and the cover member includes engaging areas. The engaging areas engage with the inter-engaging portions to permit the cover member to be adjustably spaced from the base assembly to accommodate sidings having various thicknesses.

29 Claims, 6 Drawing Sheets

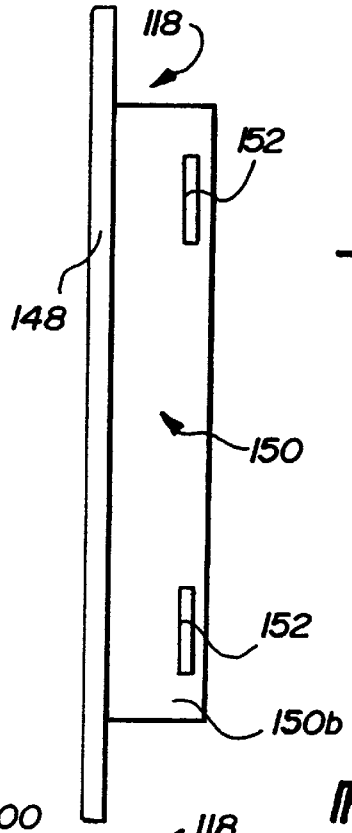
Fig-15
Fig-16
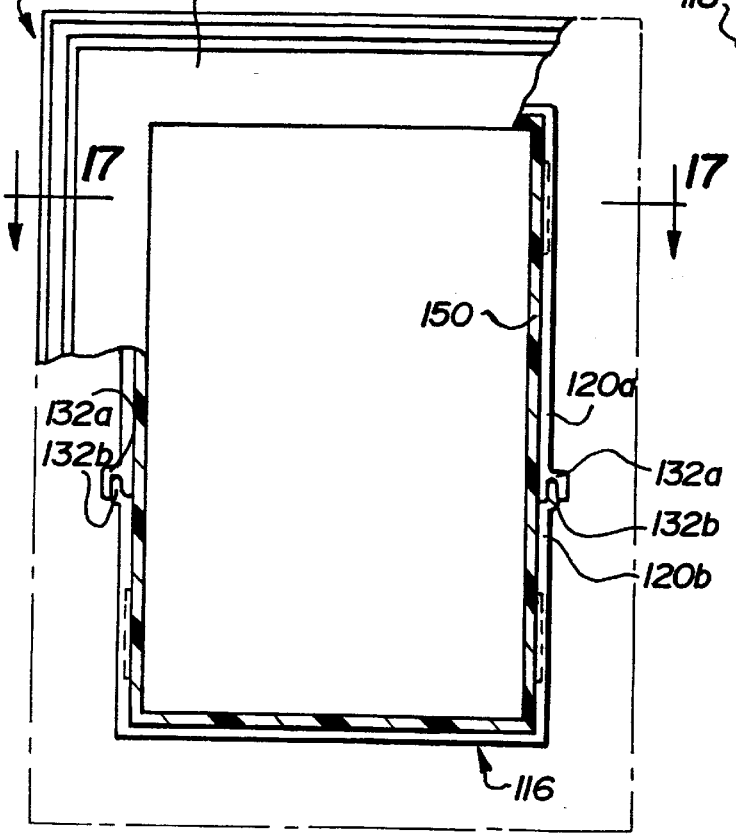
Fig-17
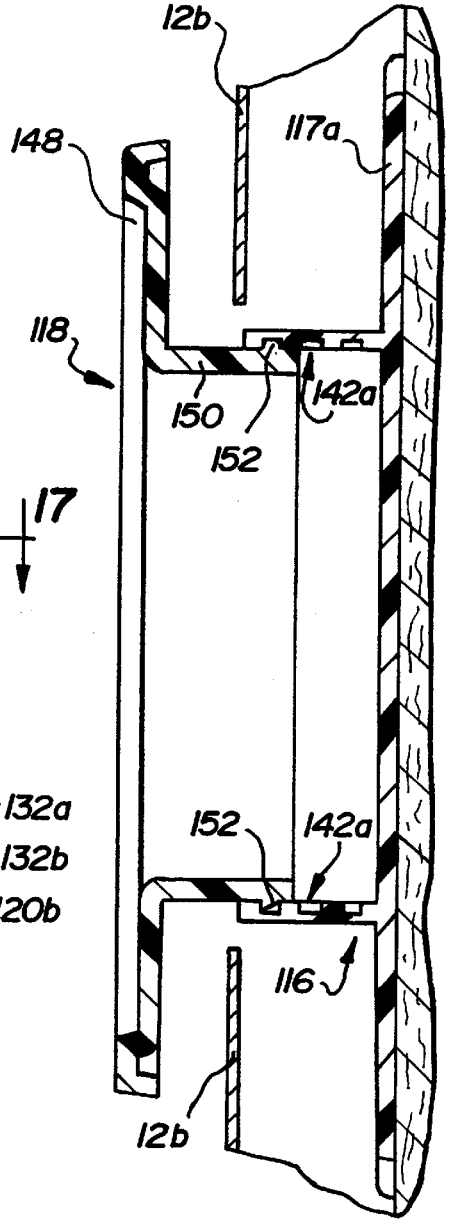

SPLIT-BLOCK RECESS MOUNT APPARATUS

CROSS-REFERENCE TO RELATED APPLICATIONS

This present application is a continuation-in-part patent application of U.S. application ser. No. 08/715,999, filed Sep. 19, 1996, and entitled "Component Hose Bib", abandoned.

BACKGROUND OF THE INVENTION

1. Technical Field

This invention relates to a split-block recess mount block apparatus for providing a finished, decorative appearance to the area adjacent a conduit protruding through the exterior surface of a building such as a residential or commercial dwelling.

2. Discussion

Many residential and commercial dwellings often have one or more conduits extending through an exterior surface of the structure. One specific example is a conduit forming a water pipe which extends through an exterior surface of a residential or commercial dwelling and which has a water faucet attached at an outer end thereof. Another example is an electrical conduit for one or more electrical conductors. Still another example would be a conduit carrying a cable television line. In some instances no conduit may even be used, that is, the television cable may be extending through an opening in a wall of the structure by itself with no plastic or metal conduit enclosing it.

Depending upon the exterior surface of the building, whether the surface is covered by vinyl siding, aluminum siding, brick, or wood, the area immediately surrounding the conduit often forms somewhat of an unsightly area or an area that is difficult to substantially cover with vinyl, aluminum or wood siding. Often it is difficult to cut or trim the siding to a degree where the siding extends almost up to the outer surface of the conduit. Accordingly, the area immediately surrounding a conduit often does not have a "finished" appearance matching that of the remainder of the structure.

In an effort to provide some form of structure to cover the area immediately surrounding the conduit, various forms of decorative covers have been developed. These prior-developed covers have met with limited success, however, because of a variety of drawbacks. One drawback is that, depending upon the overall thickness of the siding of the structure, the cover may need to be spaced closer to or farther away from the outer surface of the structure to allow edge portions of the siding to slide behind the cover. Other forms of covers have suffered from other drawbacks which limit their effectiveness.

Accordingly, it is a principal object of the present invention to provide an apparatus which may be quickly and easily secured to an exterior surface of a building such as a residential or a commercial dwelling to substantially cover the area immediately surrounding a conduit or cable projecting through an outer wall of the building, to thus provide a decorative, finished-looking appearance to this area of the structure.

It is still another object of the present invention to provide an apparatus which includes a two piece base assembly which may be easily secured to an exterior surface of a building on opposite sides of a conduit or cable projecting through the exterior surface of the building, and which further includes an independent snap-on cover member.

It is still another object of the present invention to provide an apparatus having a two piece base assembly which may be secured to an exterior surface of a dwelling on opposite sides of a conduit or cable projecting through the exterior surface through the use of conventional fastening elements such as threaded screws or nails, and a one-piece cover member which may be adjustably secured to the base assembly to position the cover member either closer to or further away from the exterior surface of the building to accommodate sidings having various thicknesses.

It is yet another object of the present invention to provide an apparatus which is relatively inexpensive, easy to install, light in weight and durable to provide a longlasting, decorative appearance to the area immediately surrounding a conduit or cable projecting through an exterior surface of a dwelling.

SUMMARY OF THE INVENTION

The above and other objects are provided by a split-block recess mounting apparatus in accordance with preferred embodiments of the present invention. The apparatus generally comprises a two-piece base assembly and a one-piece cover member. The two-piece base assembly is comprised of first and second base portions which each have an upstanding inner wall, a mounting flange for securing to an exterior surface of a building, and a central panel portion having a cut out. Each base portion further has structure for helping to align and releasably secure it to the other after each has been placed against the exterior surface of a building closely adjacent the conduit, cable or other like member projecting through the exterior surface. Once secured to the exterior surface, the cutouts and the central panel portions form a single, generally continuous opening which circumscribes the conduit.

The cover member includes an inner protruding wall portion and a decorative flange. The inner protruding wall portion is dimensioned so as to be engageable with the upstanding inner wall of the first and second base portions so as to be held thereto without any external fastening elements.

In one preferred embodiment the upstanding inner wall portions of the base assembly and the inner protruding wall portion of the cover member include cooperating structure for enabling the cover member to be adjustably positioned closer to or farther away from the exterior surface of the dwelling. The space between the mounting flanges of the base assembly and the decorative flange of the cover member is sufficient to permit the edges of the siding secured to the exterior surface of the building to extend therebetween. In this manner, sidings having varying thicknesses can be accommodated by simply adjustably positioning the cover member either closer to or farther away from the base assembly.

In one preferred embodiment the first and second base portions each include overlapping flange portions. The overlapping flange portions include structure which cooperates to releasably secure the two base portions together after they have been positioned against the exterior surface of the dwelling adjacent a conduit projecting through the exterior surface.

The apparatus of the present invention is preferably formed from a relatively high strength plastic and is relatively inexpensive, easy to install, light in weight and durable. Since the apparatus is formed from plastic, and preferably injection molded, the apparatus can be formed in a variety of colors to more closely match the color of the siding of the structure to which the apparatus is secured. The apparatus will not warp, crack or split due to routine exposure to the elements. Moreover, no periodic maintenance such as painting, staining, etc. is required to keep the apparatus looking new.

The apparatus is further simple and easy to install with conventional tools and does not require any modification to or disassembly of the conduit or any member that may be secured to the conduit.

BRIEF DESCRIPTION OF THE DRAWINGS

The various advantages of the present invention will become apparent to one skilled in the art by reading the following specification and subjoined claims and by referencing the following drawings in which:

FIG. 15 is a side view of the cover member in accordance with directional arrow 15—15 in FIG. 14;

FIG. 16 is a fragmentary cross sectional view of the cover member secured to the base assembly; and FIG. 17 is a cross sectional side view of the cover member secured to the base assembly in accordance with directional arrow 17—17 in FIG. 16.

DETAILED DESCRIPTION OF THE PREFERRED EMBODIMENTS

Figure 1:
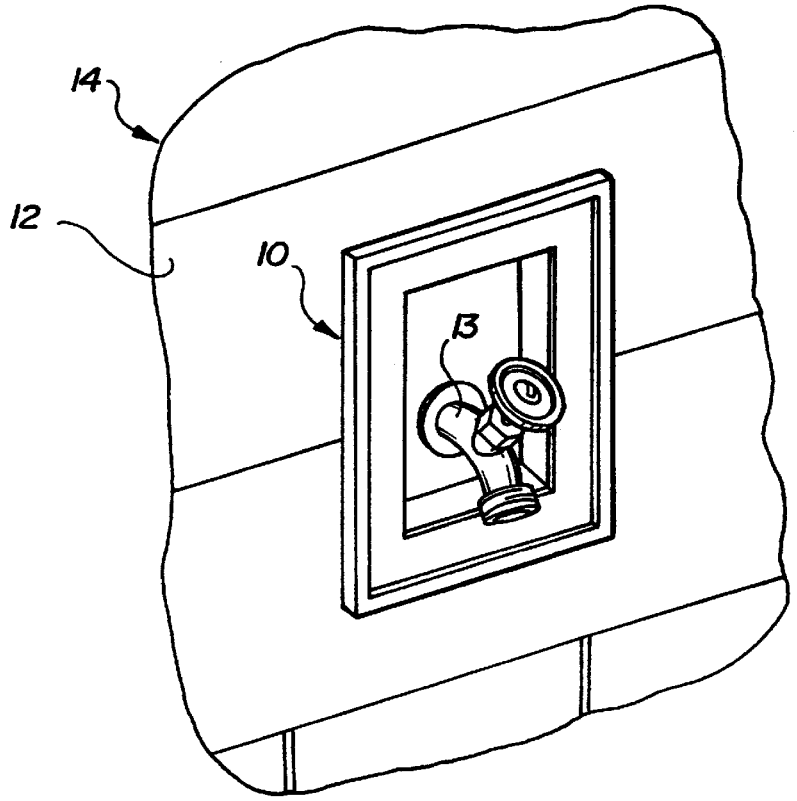
FIG. 1 is a view of an exterior surface of a building showing the split-block recess mounting apparatus of the present invention secured to the building to circumscribe an area immediately adjacent a water faucet.

Referring to FIG. 1, there is shown a split-block recess mounting apparatus 10 in accordance with a preferred embodiment of the present invention. The apparatus 10 is shown secured to an exterior surface 12 of a dwelling 14 to provide a decorative appearance to the area immediately surrounding a water faucet 13 at the end of a fluid-carrying conduit (not visible). It will be appreciated immediately that while the apparatus 10 has been shown in use with a water faucet 13 and a water-carrying conduit, that the apparatus 10 could be used to provide a decorative appearance to the area surrounding any tubular member projecting through the exterior surface 12, or even any cable which is not enclosed. Other forms of conduit might comprise a condenser line from a condenser of an air conditioning system passing into the interior area of the dwelling 14, or even possibly coaxial or other cabling used for television. Accordingly, it will be appreciated that the use of the apparatus 10 is not limited to water-carrying conduits but virtually any cylindrical or tubular member or any cable or elongated member which projects through the exterior surface 12.

With further reference to FIG. 1, it can be seen that the apparatus 10 allows the cut edges of siding secured to the dwelling to be covered. This provides an aesthetically pleasing and neat, finished looking appearance to an area (i.e. that area immediately surrounding the water faucet 13) that would otherwise not have such a finished looking appearance.

Figure 2:
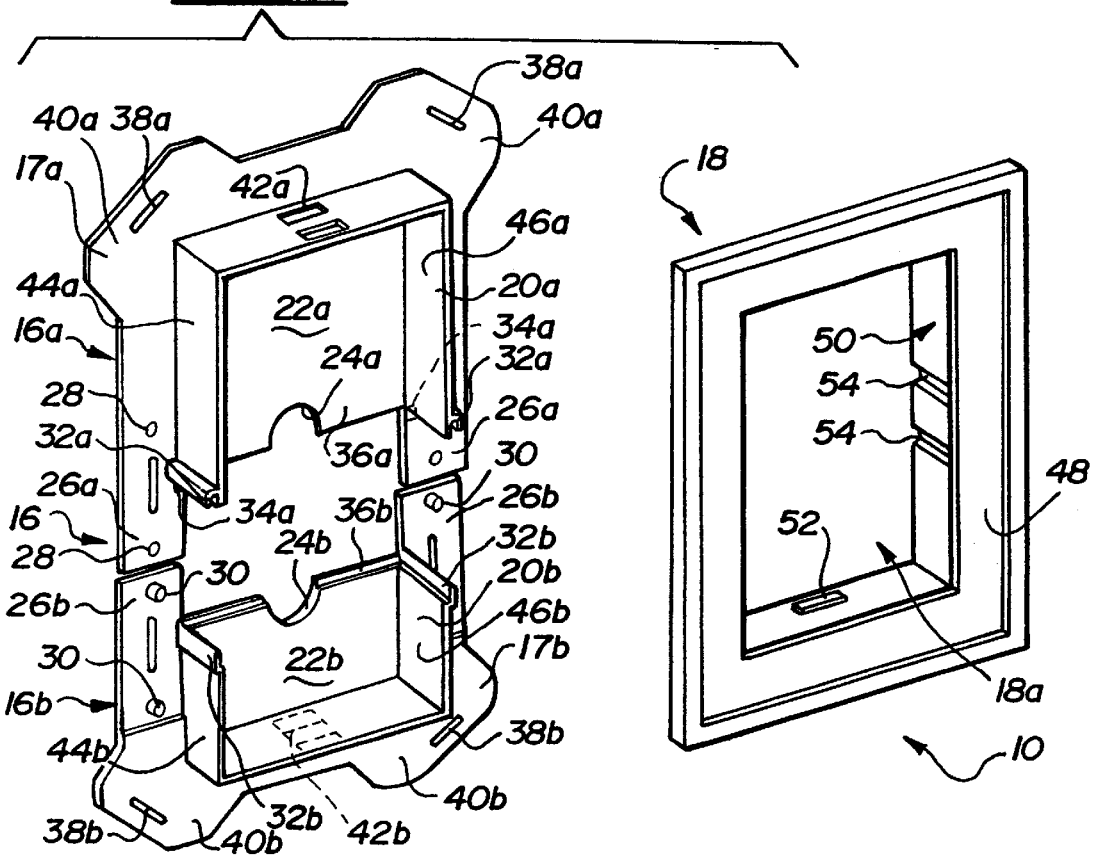
FIG. 2 is an exploded perspective view of the base assembly and the cover member of the present invention.

Referring now to FIG. 2, the apparatus 10 generally includes a base assembly 16 and a one-piece cover member 18. The base assembly 16 is comprised of first and second base portions 16*a* and 16*b*. Each of the base portions 16*a* and 16*b* include a generally continuous mounting flange 17*a* and 17*b*, respectively, and an integrally formed, upstanding inner wall 20*a* and 20*b*, respectively. The first base portion 16*a* further includes a central panel portion 22*a* having a generally semicircular cutout 24*a* along one edge portion, and overlapping flange portions 26*a*. The second base portion 16*b* similarly includes a central panel portion 22*b* having a cutout 24*b* and overlapping portions 26*b*. The cutouts 24*a* and 24*b* are further positioned so as to form one continuous opening when the first and second base portions 16*a* and 16*b* are releasably secured together through which a conduit may project.

With further reference to FIG. 2, the overlapping portions 26*a* each include a plurality of apertures 28 and the overlapping portions 26*b* include a plurality of upstanding locking members or bosses 30. The overlapping portions 26*a* further include interlocking portions 32*a* which form slots and notched out areas 34*a* formed closely adjacent the interlocking areas 32*a*. The central panel portion 22*a* further includes a lip portion 36*a* which is also visible in the drawing of FIG. 8.

Figure 8:
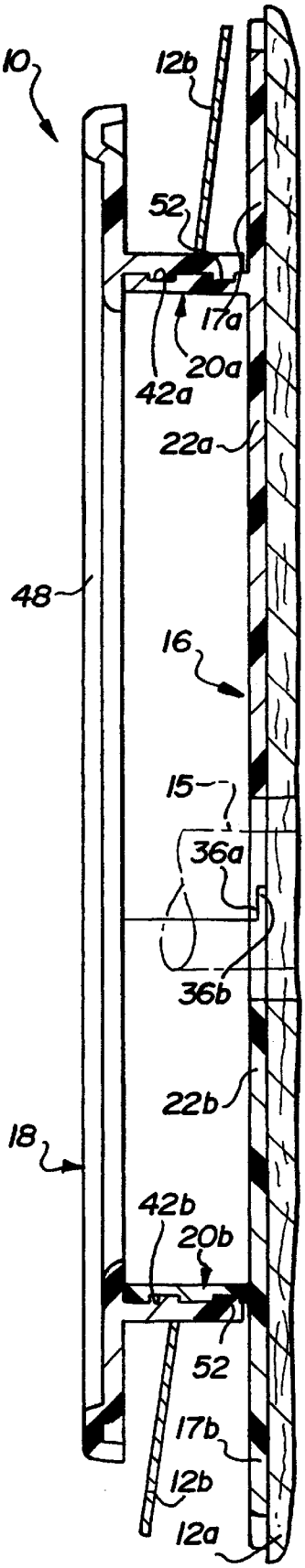
FIG. 8 is a cross sectional side view in accordance with section line 8—8 in FIG. 7 showing the interengagement of the two base portions of the base assembly and the interengagement of the cover member with the base assembly.

With further reference to FIGS. 2 and 8, the second base portion 16*b* includes interlocking portions 32*b*, a notched edge portion 36*b* extending along an edge of the central portion 22*b*. The mounting flange 17*a* and the mounting flange 17*b* each include a plurality of elongated slots 38*a* and 38*b*, respectively, which are dimensioned to accept threaded screws or nails or other forms of fastening implements therethrough. The mounting flanges 17*a* and 17*b* also include a plurality of ear portions 40*a* and 40*b*, respectively, which form enlarged surfaces enabling external fastening elements such as threaded screws or nails to be easily driven in through the elongated slots 38*a* and 38*b*.

With further reference to FIGS. 2 and 8, the first and second base portions 16*a* and 16*b* can be seen to include inter-engaging portions 42*a* and 42*b*. These portions 42*a* and 42*b* form notches or recesses which are molded or cut into outer surfaces 44*a* and 44*b* of the upstanding inner walls 20*a* and 20*b*, respectively. It will be appreciated, as explained further herein, that these inter-engaging portions 42*a* and 42*b* could just as easily be formed on inner surfaces 46*a* and 46*b* of the upstanding inner walls 20*a* and 20*b* if desired, with only minor modifications to the cover member 18.

Figure 3:
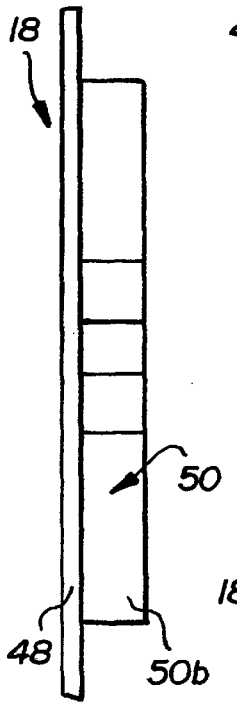
FIG. 3 is a side view of the cover member shown in FIG. 2.
Figure 4:
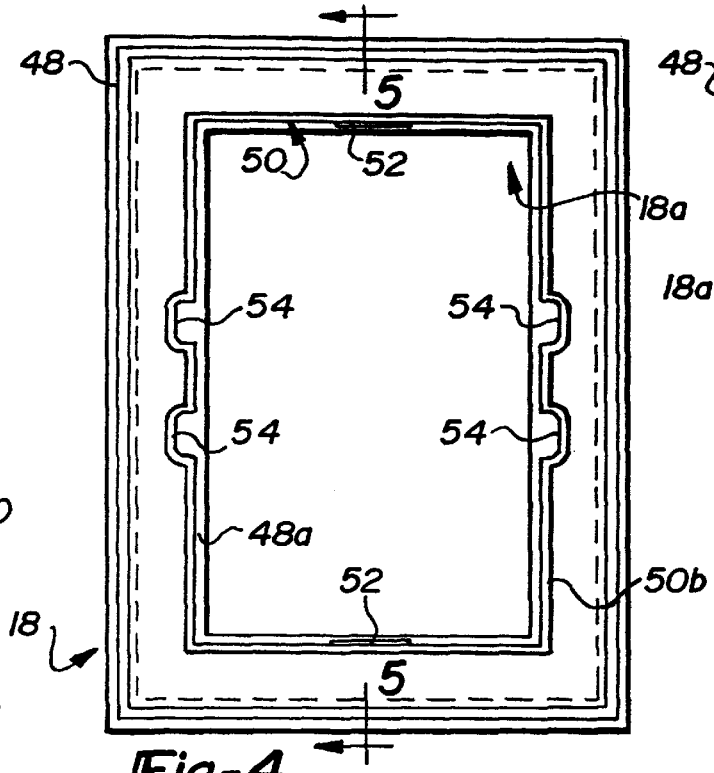
FIG. 4 is a rear view of the cover member.
Figure 5:
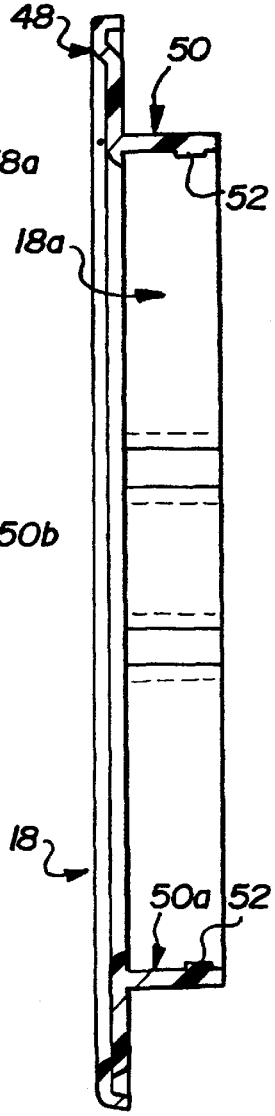
FIG. 5 is a cross sectional side view of the cover member taken in accordance with section line 5—5 in FIG. 4.

With further reference to FIGS. 3–5, the cover member 18 is preferably molded as a one-piece component part and includes a continuous, decorative flange 48 and an inner protruding wall portion 50 extending generally perpendicularly from the flange 48 continuously about the entire inner edge 48*a* of the flange 48. The flange 48 and the wall portion 50 form an opening 18*a* which permits a conduit to pass through the cover member 18.

The inner protruding wall portion 50 is dimensioned such that it fits over the upstanding inner wall portions 20*a* and 20*b* of the base assembly 16 when portions 16*a* and 16*b* are releasably secured together. With specific reference to FIG. 4, the decorative flange 48 is preferably large enough to extend past the inner protruding wall portion on all four sides of the wall portion 50 by an amount sufficient to allow siding positioned closely adjacent the inner wall portion 50 to be completely covered by the decorative flange 48.

With specific reference to FIG. 5, an inner surface 50*a* of the inner protruding wall portion 50 includes a pair of integrally formed engaging areas 52 which each comprise integrally formed step or shoulder portions. The inner surface 50*a* further includes a plurality of recessed areas 54 (FIG. 4) which are formed in the inner surface 50*a* so as to align with the interlocking areas 32*a* and 32*b* to provide clearance for these areas when the cover member 18 is secured to the base assembly 16. It will be appreciated also that the notches or shoulder portions 52 could just as easily be formed on an exterior surface 50*b* (FIGS. 3 and 4) if the inner protruding wall portion 50 is to be inserted within the upstanding inner walls 20*a* and 20*b* instead of over the walls 20*a* and 20*b*.

Figure 6:
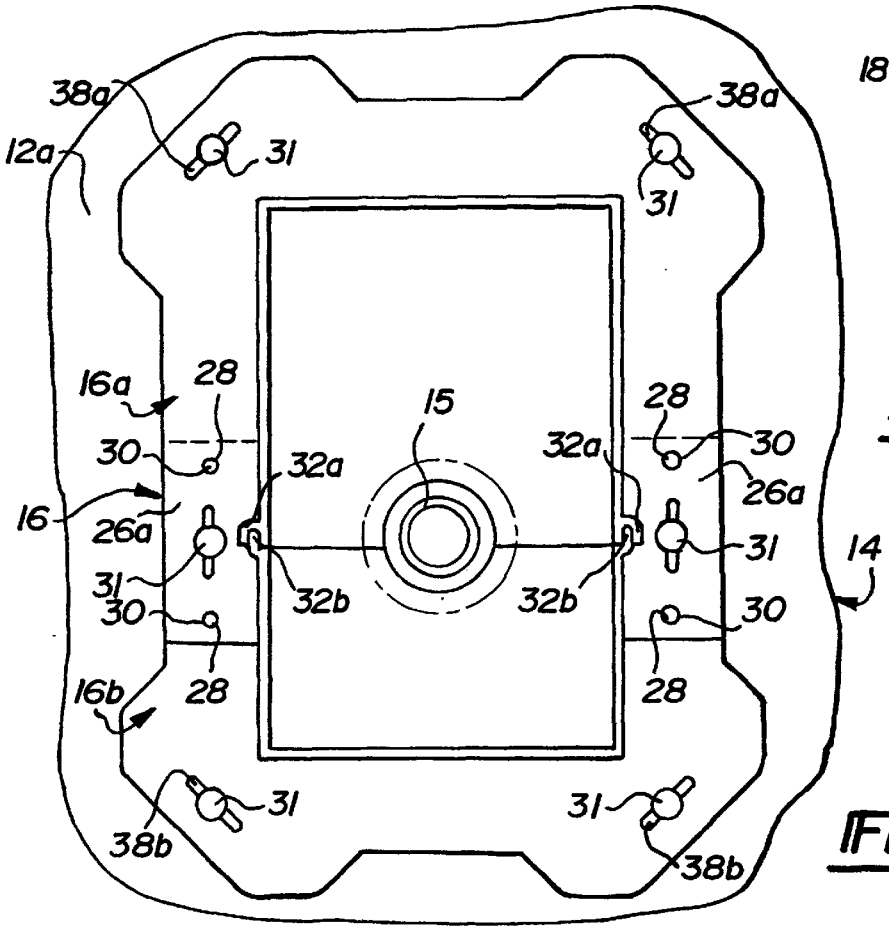
FIG. 6 is a view showing the base assembly secured around a water pipe projecting through the exterior surface of the building.
Figure 7:
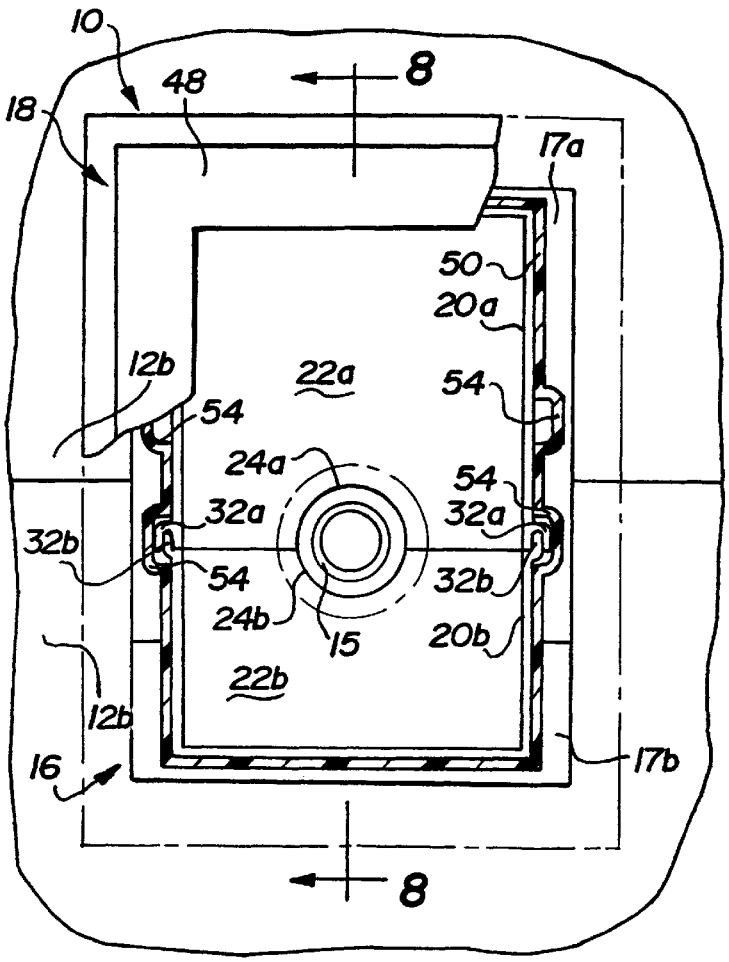
FIG. 7 is a view of the apparatus 10 secured to the exterior surface of the building and illustrating siding strips positioned over the mounting flanges of the base assembly.

Referring now to FIG. 6, the assembly of the apparatus 10 to an exterior surface 12*a* of the dwelling 14 will be described. Initially, the first and second base portions 16*a* and 16*b* are placed over a water pipe 15 on opposite sides of the water pipe. The first and second base portions 16*a* and 16*b* are then urged towards one another such that the overlapping portions 26*b* slide underneath the overlapping portions 26*a* and the upstanding locking members 30 engage within the apertures 28, and further until the interlocking portions 32*b* engage with the interlocking portions 32*a*. At this point the first and second base portions 16*a* and 16*b* are releasably secured together. External threaded screws or nails 31 can then be driven through the slots 38*a* and 38*b* to hold the base assembly 16 securely against the exterior surface 12 of the dwelling 14, as shown in FIG. 6. Thereafter, as shown in FIG. 7, siding strips 12*b* can be secured such that edges thereof are in close proximity to the upstanding inner walls 20*a* and 20*b*. The interlocking of the base portions 16*a* and 16*b* is also illustrated in FIG. 8.

Once the base portion 16*a* and 16*b* are secured to the exterior surface 12 and the siding strips 12*b* secured in place, the cover member 18 can then be pressed on over the upstanding inner wall portions 20*a* and 20*b* of the base assembly 16 such that the shoulder portions 52 engage within the notches 42*a* and 42*b*. Since a plurality of pairs of notches 42*a* and 42*b* are provided, the cover member 18 can be positioned either closer to or farther away from the exterior surface 12 of the dwelling 14 as needed to accommodate siding strips having varying thicknesses. The components of the base assembly 16 and the cover member 18 are each preferably injection molded from a suitable high strength plastic, such as polystyrene or polypropylene, to form rigid and strong, yet lightweight component parts. Since all of the components of the apparatus 10 are molded from a suitable plastic, the apparatus 10 can be molded in various colors to match different colors of siding. The apparatus 10, being molded from plastic, is much more weather resistant and not susceptible to splitting, cracking, swelling, etc., which assemblies manufactured from wood could suffer from. The apparatus 10 is further very light in weight, relatively inexpensive to produce and can be installed quickly and easily without special tools and without special training by the individual performing the installation.

It will be appreciated, however, that if the apparatus 10 is installed on an exterior building surface which already has siding strips secured thereto, that a portion of the siding strips may have to be cut to form an opening suitable to allow the mounting flange portions 17*a* and 17*b* to rest flat against the exterior surface 12*a*. Thus, it will be appreciated that the apparatus 10 is suitable for new construction or for remodeling purposes where an owner or occupant of a dwelling wishes to enhance the appearance of those areas immediately around conduits, cables or other elongated members protruding from the outside of the structure.

It will also be appreciated that the apparatus 10 could be readily adapted for use with virtually any form of cylindrical or tubular member which projects through an exterior surface of a building. This would even include use with electrical boxes or other fixtures which include cabling or sections of conduit which protrude through the exterior surface of the building, and which would otherwise cause difficulty in providing a finished looking appearance to those areas immediately surrounding the cabling or conduit.

Moreover, while the apparatus 10 has been shown as a generally square-shaped apparatus, it will be appreciated that the apparatus 10 could be formed in a variety of shapes to suit individual design tastes. For example, the upstanding inner walls 20*a* and 20*b* could be formed in semi-hexagon forms and the cover member 18 formed in the shape of a hexagon. Diamond shapes, pentagons, and other shapes could also readily be implemented with only little modification to the apparatus 10.

Figure 9:
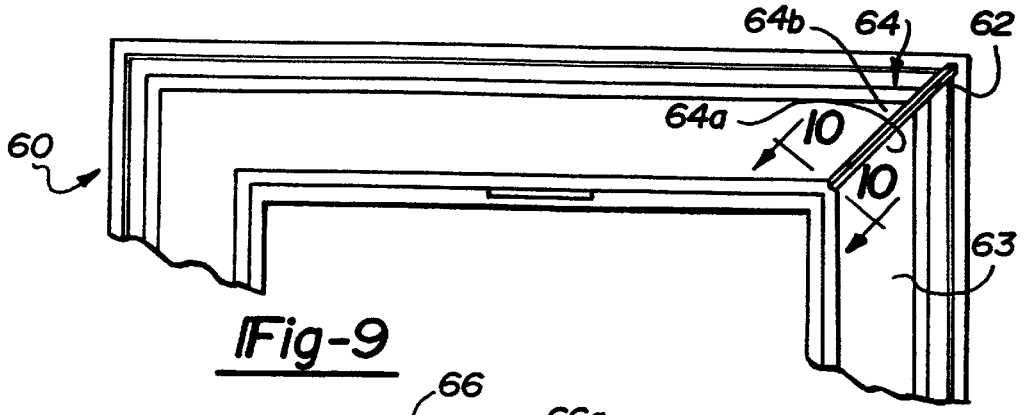
FIG. 9 is an alternative preferred embodiment of the present invention incorporating a cover member having a groove or relief area formed at one corner.
Figure 10:
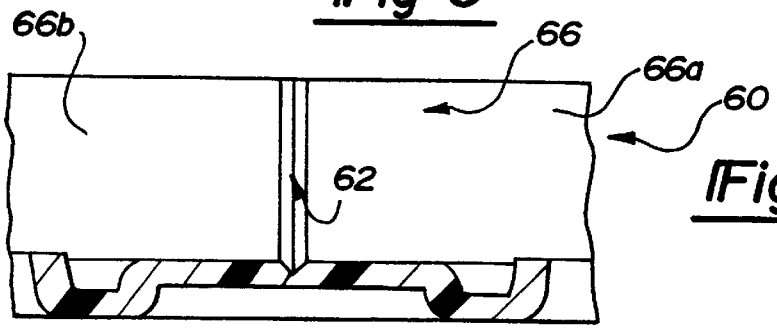
FIG. 10 is a cross-sectional view of the cover member of FIG. 9 taken in accordance with section line 10—10 in FIG. 9.

Referring now to FIGS. 9 and 10, there is shown a portion of a cover member 60 in accordance with an alternative preferred embodiment of the present invention. The cover member 60 is identical to the cover member 18 shown in FIG. 2 with the exception that a groove or relief area 62 is formed at one corner 64 of the member 60. The groove 62 is preferably integrally formed with the cover member 60 during molding of the members 60 and reduces the thickness at the area defined by the groove 62 to about 0.020 inch. The groove 62 extends along at least a major portion of a decorative flange portion 63 and down along an inner protruding wall portion 66 of the cover member 60 between adjacent walls 66*a* and 66*b* of the wall portion 66. The groove 62 makes it possible to easily cut through the decorative flange 63 and the inwardly protruding wall portion 66 with a utility knife or other sharp instrument to separate the corner portion 64 into portions 64*a* and 64*b* to allow the cover member 60 to be placed over an existing condenser line, conduit, cable or other member which is already coupled to some external device. In this manner, the cover member 60 can be used in a wide variety of applications where it would not be possible to install the member 60 over an existing conduit or other like member without providing a means for opening the cover member to allow it to be slipped over the conduit. The cover member 60 thus expands the utility of the apparatus of the present invention to a wide variety of applications in which an existing conduit is present and attached to some other device and cannot be readily uncoupled from such device.

Figure 11:
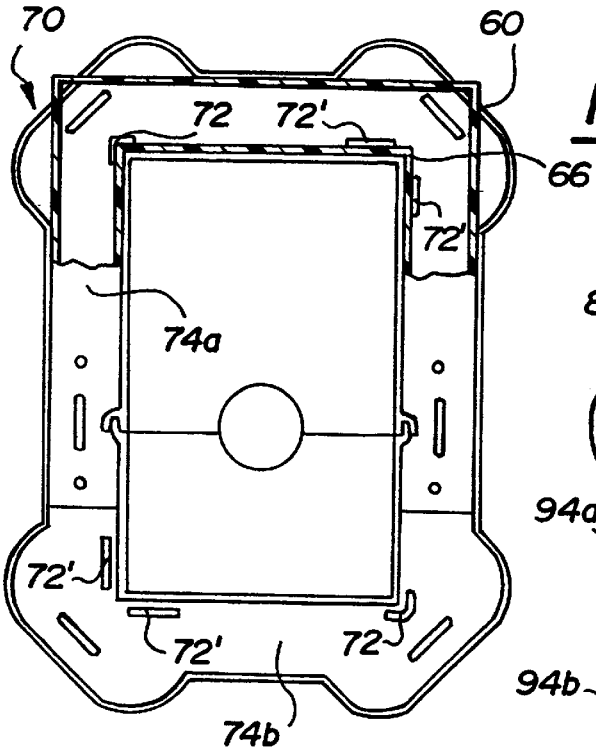
FIG. 11 is a plan view of an alternative embodiment of a base assembly for use with a portion of the cover member shown in FIG. 9 attached thereto.

Referring now to FIG. 11, there is shown a base assembly 70 in accordance with an alternative preferred embodiment of the present invention. The base assembly 70 is intended for use with the cover member 60 to help hold the corner portion 64 securely together after same has been cut and secured to the base assembly 70. While it is possible that the member 60 may be used with satisfactory results with the base assembly 16 shown in FIG. 2, it is anticipated that in most instances it will be preferred to incorporate some structure on the base assembly 16 which will positively hold the cut edges at the area of groove 62 securely abutting one another once the cover member 60 is installed.

With continuing reference to FIG. 11, the base assembly 70 is identical to the base assembly 16 with the exception of the addition of a pair of either angled upstanding wall portions 72 or wall portions 72', integrally formed with mounting flange portions 74*a* and 74*b*. Although both wall portions 72 and 72' could be incorporated if desired, only one pair is needed to ensure that the corner portions 64*a* and 64*b* are held abuttingly against each other.

The angled upstanding wall portions 72 extend generally perpendicularly from the mounting flanges 74*a* and 74*b* and are located diagonally opposite one another. When the cover member 60 is secured to the base assembly 70 after the member 60 has been cut at corner portion 64, the member 60 is orientated such that corner portion 64 is adjacent one or the other of the upstanding angled wall portions 72. The wall portions 72 serve to prevent the wall portion 66*a* and 66*b* from separating once the cover member 60 is secured to the base assembly 70. FIG. 11 illustrates the interengagement of the inwardly protruding wall portion 66 of the cover member 60 with one upstanding angled wall portion 72 of the base assembly 70. Wall portions 72' operate in the same fashion to hold the portions 64*a* and 64*b* abuttingly together.

Figure 12:
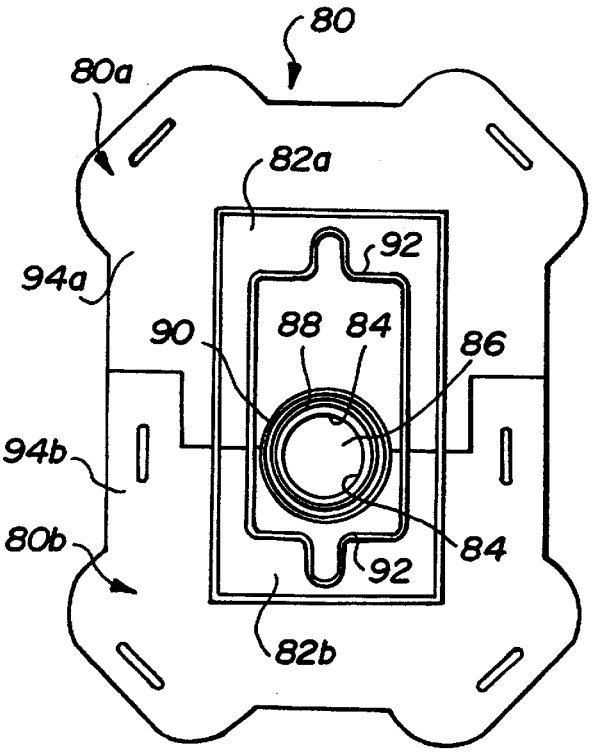
FIG. 12 is a rear view of an alternative preferred embodiment of the base assembly incorporating several relief areas where portions of the central area may be readily knocked out to accommodate conduits having different diameters or an electrical receptacle.

Referring now to FIG. 12, yet another alternative preferred embodiment 80 of the base assembly of the present invention is shown. Base assembly 80 is essentially identical to base assembly 16 shown in FIG. 2 with the exception that the central panel portions 82*a* of each portion 80*a* and 80*b*, respectively, of the base assembly 80 include several grooves formed therein for permitting the diameter of the opening formed therein to be modified as needed to suit a specific application. Specifically, each of the central panel portions 82*a* and 82*b* include a semi-circular edge 84 which form a generally circular opening 86 when the two portions 80*a* and 80*b* are secured together. Concentric with opening 86 are a pair of semi-circular grooves 88 and 90 formed into the central panel portions 82*a* and 82*b* to form concentrically arranged circular grooves having a thickness on the order of about 0.020 inch which can easily be cut through with a utility knife or other like instrument if an opening larger than opening 86 is needed. Thus, groove 88 can be traced with the utility knife to provide an opening, as can circular groove 90.

Each of the central panel portions 82*a* and 82*b* also includes a portion of groove 92 which forms an outline of the shape of a duplex electrical receptacle when the portions 80*a* and 80*b* are assembled together. Thus, if the apparatus of the present invention is to be used to cover an outdoor electrical box, a utility knife can be used to cut along the groove 92 and the cut sections removed. The base assembly 80 can then be positioned over the electrical receptacle without further modification to either one of the portions 80*a* or 80*b*.

Figure 13:
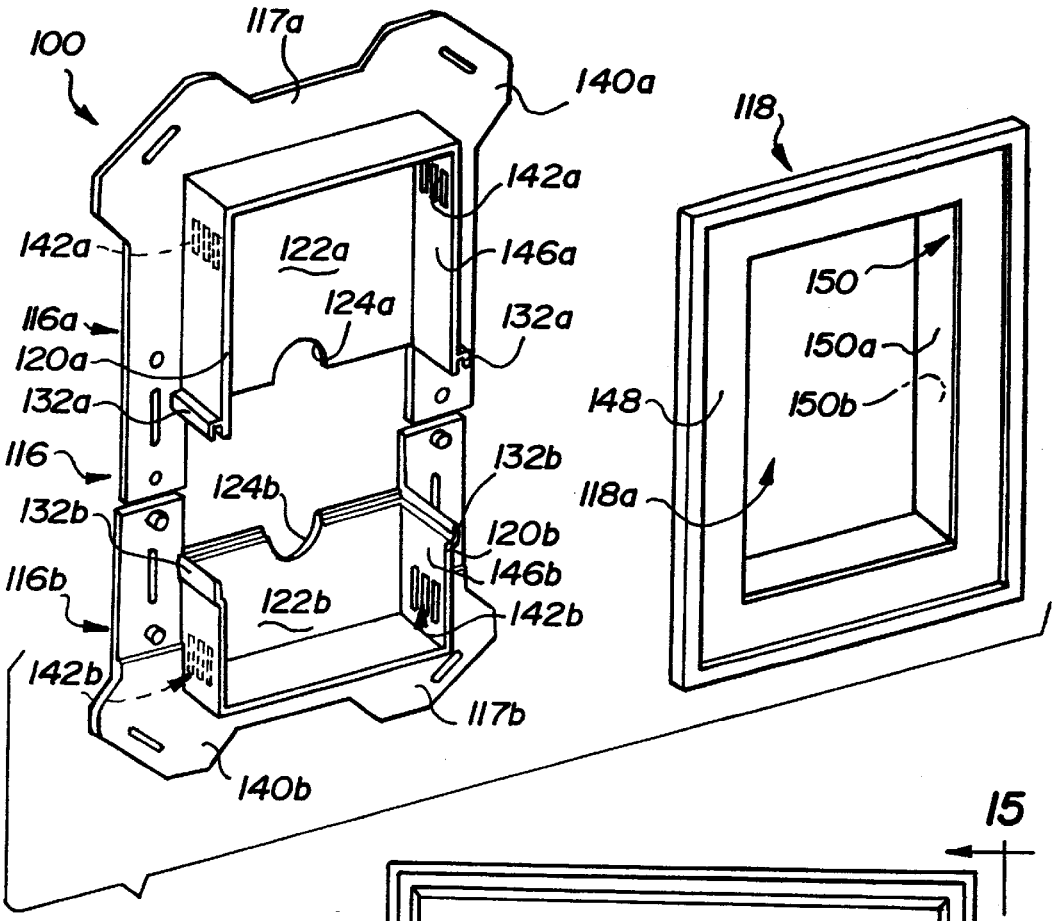
FIG. 13 is an exploded perspective view of a hose bib assembly in accordance with an alternative preferred embodiment of the present invention.

Referring now to FIG. 13, there is a split-block recess mounting apparatus 100 in accordance with another alternative preferred embodiment of the present invention. The apparatus 100 is similar to the apparatus 10 shown in FIGS. 1–8 in several respects. In this regard, like reference numerals will be used for similar features with the exception that the reference numerals used in connection with FIGS. 13–17 will be increased by 100 over those denoting like features or components in FIGS. 1–8.

Figure 14:
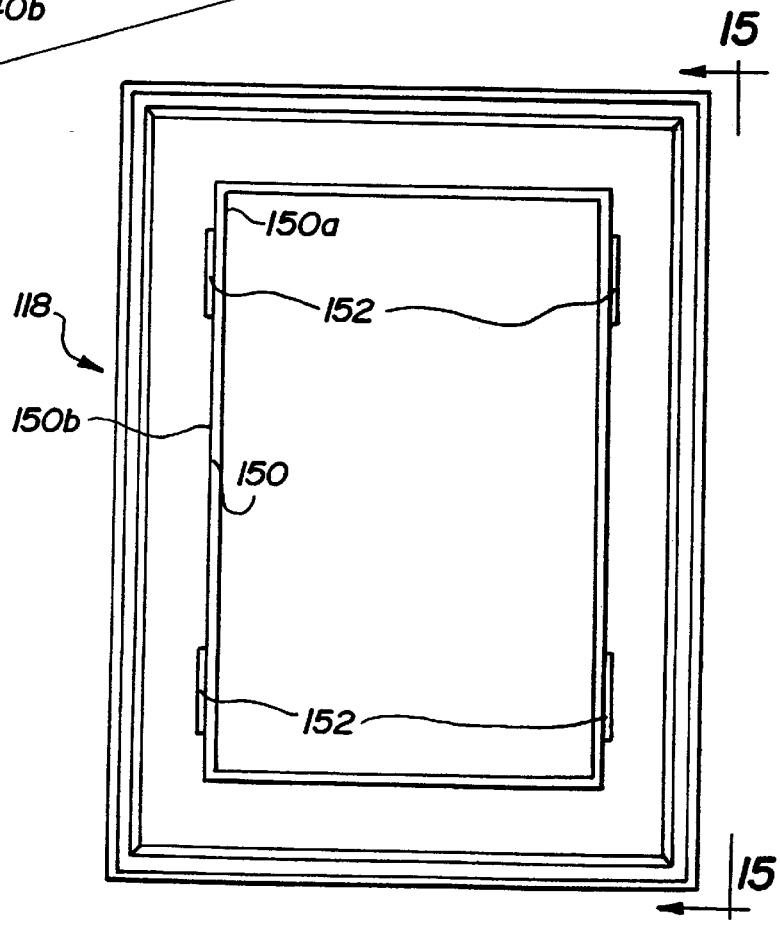
FIG. 14 is a rear plan view of the cover member shown in FIG. 13.

The apparatus 100 is similar to the apparatus 10 with the exception of interengaging portions 142*a* and 142*b* formed on the inner surfaces 146*a* and 146*b* of the upstanding inner walls 120*a* and 120*b*, respectively. Referring to FIG. 14, the cover member 118 is also substantially identical to the cover member 18 with the exception that the engaging areas 152 are formed not on an inner surface 150*a* of the inner protruding wall portion 150 but rather on an outer surface 150*b* of the wall portion 150, as will be explained more fully momentarily.

With further reference to FIG. 13, it will be noted that the inter-engaging portions 142*a* and 142*b* each include a plurality of spaced apart recesses forming notches. Each of the inter-engaging portions 142*a* and 142*b* are further formed on the inside surfaces 146*a* and 146*b* of the upstanding inner walls 120*a* and 120*b*, respectively.

Referring now to FIGS. 14–16, the cover member 118 can be seen in further detail. It will be appreciated that the wall portion 150 is dimensioned such that it fits snugly within the upstanding inner walls 120*a* and 120*b* of the base assembly 116 (FIG. 16) after the base assembly has been secured to a structure.

With further reference to FIG. 15, the engaging areas 152 can each be seen to form a rectangular protrusion. These protrusions are further positioned such that they align with the inter-engaging portions 142*a* and 142*b* of the base assembly 116. A decorative flange 148 hides the engaging areas 152 from view once the cover member 118 is secured to the base assembly 116. It will be appreciated, however, that the shape of the protrusions forming the engaging areas 152 could vary widely from the rectangular shape illustrated in FIG. 15.

Referring specifically to FIGS. 16 and 17, the interengagement of the engaging areas 152 and the inter-engaging portions 142*a* and 142*b* can be seen. From FIG. 17, it will be appreciated that during assembly the inner protruding wall portion 150 is inserted within the upstanding inner walls 120*a* and 120*b* such that the areas 152 engage with portions 142*a* and 142*b*. The cover member 118 may be spaced closer to or farther away from the base assembly 116 depending upon which ones of the notches of the inter-engaging portions 142*a* and 142*b* are engaged with the engaging areas 152. This enables the cover member 118 to be installed so as to provide a variable spacing between flanges 117*a*, 117*b* and the decorative flange 148 (FIG. 17) to accommodate siding having a variety of widths. The engagement of the inner protruding wall portion 150 within the upstanding inner walls 120*a* and 120*b* also provides an aesthetically clean appearance regardless of the spacing of the cover member 118 relative to the base assembly 116.

Those skilled in the art can now appreciate from the foregoing description that the broad teachings of the present invention can be implemented in a variety of forms.

Therefore, while this invention has been described in connection with particular examples thereof, the true scope of the invention should not be so limited since other modifications will become apparent to the skilled practitioner upon a study of the drawings, specification and following claims.

What is claimed is:

1. An apparatus for securing to an exterior surface of a building closely adjacent to a member protruding from the exterior surface, said apparatus comprising:

a base assembly including a first portion and a second portion, each of said first and second portions including a central panel portion having a cut-out, said first and second portions being independently separable and each including interlocking portions for enabling said first and second portions to be releasably secured together;

said cutouts in said first and second portions, when said first and second portions are secured together, forming a first opening for permitting passage of a member therethrough;

each of said first and second portions including portions for permitting each to be fixedly secured to said exterior surface of said building;

each of said first and second portions including an upstanding wall which, when said first and second portions are releasably secured together, form a continuous, upstanding inner wall portion;

an independent cover member having a second opening and being securable to said base assembly once said first and second portions of said base assembly are coupled together and said base assembly is secured to said exterior surface of said building, said second opening permitting passage of the member through said cover member; and said cover member including a continuous inner protruding wall portion having dimensions permitting engagement with an exterior surface of said continuous upstanding inner wall portion to surround said upstanding inner wall portion when said cover member is placed over said base assembly after said first and second portions are releasably secured together.

2. The apparatus of claim 1, wherein each of said upstanding inner walls include an inter-engaging portion; and wherein said inner protruding wall portion of said cover member also includes an engaging area adapted to interengage with said interengaging portions of said first and second portions of said base assembly to releasably secure said cover member to said base assembly.

3. The apparatus of claim 2, wherein said base assembly includes a plurality of inter-engaging portions spaced from one another to permit said cover member to be secured to said base assembly at varying distances from said exterior surface of said structure.

4. The apparatus of claim 1, wherein said securing portions of each of said first and second portions comprise a flange having a plurality of openings therein for enabling said first and second portions to be fixedly secured to said exterior surface of said building.

5. The apparatus of claim 1, wherein said inner protruding wall portion of said cover member comprises a continuous, inner protruding wall portion; and wherein a decorative flange is formed from said continuous, inner protruding wall portion to extend generally perpendicularly therefrom to provide a decorative flange to cover a portion of said base assembly when secured thereto.

6. The apparatus of claim 1, wherein said first and second portions include overlapping flange portions adapted to overlap each other when said first and second portions are releasably secured together.

7. The apparatus of claim 6, wherein said overlapping flange portion of one of said first and second portions includes a plurality of upstanding locking members and the other one of said overlapping portions includes a corresponding plurality of apertures adapted to engage with said upstanding locking members when said first and second portions are releasably secured together.

8. The apparatus of claim 1, wherein said base assembly includes at least one wall portion formed on each of said first and second portions to protrude outwardly of its associated said base portion; and wherein said cover member includes a groove formed thereon which facilitates cutting through said cover member with a cutting implement to form a pair of cut ends to permit said cover member to be placed over said member by separating said cut ends of said cover member; and wherein said at least one wall portion on each of said first and second portions helps to secure said cut ends securely to said base assembly.

9. The apparatus of claim 8, wherein said first and second portions each include a central panel portion; and wherein each central panel portion includes a plurality of grooves formed therein which may be cut with the cutting implement to form an opening having varying diameters.

10. The apparatus of claim 9, wherein said central panel portion of each one of said first and second portions includes a generally rectangular groove which forms an electrical receptacle opening when said generally rectangular groove is cut with the cutting implement.

11. An apparatus for securing to an exterior surface of a structure closely adjacent to a conduit extending into the structure so as to circumscribe the conduit, said apparatus comprising:

a base assembly comprising a first portion and a second portion, each of said first and second portions having interengaging structure for permitting said portions to be positioned relative to each other in a desired orientation after each of said portions is positioned against said exterior surface closely adjacent said conduit;

each of said first and second portions further including an upstanding wall portion;

each of said first and second portions further including a central panel portion having a cut-out, said cutouts being formed so as to form a single, continuous opening when said portions are positioned adjacent one another against said exterior surface of said building to permit a portion of said conduit to protrude therethrough;

each of said first and second portions further including securing areas for permitting external fastening members to be used to secure each of said first and second portions to said exterior surface of said structure when said first and second portions are positioned in said desired orientation against said exterior surface;

a cover member having a continuous inner protruding wall portion and a flange extending laterally thereof, said inner protruding wall portion being engageable with an exterior surface of said upstanding inner wall portions to surround said upstanding inner wall and hold said cover member to said base assembly and maintaining said first and second portions together; and said first and said second portions of said base assembly being independently separable.

12. The apparatus of claim 11, wherein said first and second portions each include a central panel portion;

wherein each central panel portion includes at least one groove formed therein which may be cut with the cutting implement to form an opening having varying dimensions; and wherein said grooves in said central panel portions combine when said first and second portions are joined together to define a region that may be removed from said central panel portion when said grooves are cut with the cutting implement.

13. The apparatus of claim 12 wherein said cut-outs in said first and second portions combine to form a generally circular opening and said grooves combine to form a generally circular region surrounding said generally circular opening to allow the opening to be increased in size to accommodate a larger conduit when said grooves are cut with the cutting implement and said circular region is removed.

14. The apparatus of claim 13 including additional grooves in said central panel portion of each one of said first and second portions that combine to define a generally rectangular region which forms an electrical receptacle opening when said additional grooves are cut with the cutting implement.

15. The apparatus of claim 11, wherein said upstanding wall portion of each of said first and second portions includes inter-engaging portions; and wherein said inner protruding wall portion of said cover member includes a plurality of engaging portions adapted to interengage with said inter-engaging portions of said first and second portions to thereby releasably secure said cover member to said base assembly.

16. The apparatus of claim 11, wherein said first and second portions each include planar continuous flange portions, with each of said flange portions having a plurality of openings formed therein for permitting external fastening elements to extend therethrough and secure said first and second portions to said exterior surface of said structure.

17. The apparatus of claim 16, wherein said planar, flange portions of said first and second portions each include a plurality of ear portions, with each one of said ear portions including an opening formed therein for accepting an external fastening element therethrough.

18. The apparatus of claim 11, wherein each of said first and second portions include overlapping flange portions for releasably securing said first and second portions to each other in said desired orientation.

19. The apparatus of claim 11, wherein said first portion includes interlocking portions for releasably securing said first and second portions together prior to fixedly securing said portions to said exterior surface of said structure.

20. An apparatus for circumscribing an area closely adjacent a conduit protruding through an exterior surface of a wall of a structure, said apparatus comprising:

a base assembly comprising first and second portions, each of said portions including a planar flange portion for permitting each of said first and second portions to be secured to said exterior surface of said structure and an integrally formed, upstanding inner wall projecting outwardly from its associated said flange portion, each of said flange portions including at least one opening for permitting an external fastening element to extend therethrough to secure said flange portion to said exterior surface of said structure;

each of said first and second portions further including a central panel portion with a cutout being formed in at least one of said central panel portions for permitting passage of said conduit therethrough;

a cover member having an inner protruding wall portion adapted to engage with said upstanding inner wall of said first and second portions of said base assembly and further including a flange protruding laterally of said inner protruding wall portion for partially covering said flange of each of said first and second portions said upstanding wall of said first portion including an interlocking portion adapted to receive an interlocking portion on said upstanding wall of said second portion; and said inner protruding wall portion of said cover member including a recess adapted to receive said interlocking portions on said upstanding wall of said first and second portions.

21. The apparatus of claim 20, wherein each of said first and second portions include overlapping flange portions for releasably securing said first and second portions to one another after each has been positioned closely adjacent to said conduit with said conduit projecting through the cut-out formed in at least one of said central panel portions.

22. The apparatus of claim 21, wherein said overlapping flange portions each include a plurality of interlocking portions for releasably securing said first and second portions to one another.

23. The apparatus of claim 21, wherein said overlapping portion of one of said first and second portions includes a plurality of upstanding locking members and the other one of said first and second portions includes a corresponding plurality of aligned openings for accepting said upstanding locking members once said first and second portions are positioned to form said base assembly.

24. The apparatus of claim 20, wherein each said central panel portion includes a cutout formed so as to form a generally continuous opening when said first and second portions are secured to said exterior surface of said structure.

25. The apparatus of claim 20, wherein said upstanding inner wall of each of said first and second portions includes a plurality of integrally formed inter-engaging portions spaced apart from one another; and wherein said cover member includes integrally formed engaging areas comprising shoulder portions for engaging with said inter-engaging portions to releasably secure said cover member at a plurality of distances from said exterior surface of said structure to accommodate variations in thickness of siding secured to said exterior surface of said structure.

26. The apparatus of claim 25, wherein said inter-engaging areas are formed on an inner surface of each of said upstanding inner walls of said first and second portions; and wherein said integrally formed shoulder portions are formed on an outer surface of said inner protruding wall portion of said cover member, and wherein said inner protruding wall portion has dimensions permitting it to be inserted within said upstanding inner walls and to be held thereto by the engagement of said shoulder portions and said inter-engaging areas.

27. An apparatus for surrounding an area adjacent to a protruding member on an exterior surface of a building, said apparatus comprising:

a first member including first and second portions which can be secured together by interlocking portions;

an independent second member securable to said first member when said first and second portions of said first member are coupled together;

said second member including a recess adapted to receive said interlocking portions of said first member;

one of said first and said second members comprising a base member including a cut-out adapted to permit passage of the protruding member; and said other of said first and second members comprising a cover member securable to said base member.

28. The apparatus of claim 27 wherein:

said first member comprises said base member having said first and second portions;

said second member comprises said cover member;

each of said first and second portions of said base member include an upstanding wall which can be coupled together to form a continuous, upstanding inner wall portion when said first and second portions are coupled together; and said cover member includes an inner protruding wall portion having dimensions permitting engagement with said continuous upstanding inner wall portion of said base member.

29. The apparatus of claim 28 wherein:

said recess is disposed on said inner protruding wall portion of said cover; and said interlocking portions of said base assembly are disposed on said upstanding inner wall portion of said base.

* * * * *